US008398071B2

(12) United States Patent
Suzuki

(10) Patent No.: US 8,398,071 B2
(45) Date of Patent: Mar. 19, 2013

(54) AIR SHEET FEEDING DEVICE AND IMAGE FORMING SYSTEM HAVING IMAGE FORMING APPARATUS TO WHICH THE AIR SHEET FEEDING DEVICE IS CONNECTED

(75) Inventor: Tomoo Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/329,879

(22) Filed: Dec. 19, 2011

(65) Prior Publication Data

US 2012/0161384 A1 Jun. 28, 2012

(30) Foreign Application Priority Data

Dec. 22, 2010 (JP) ..... 2010-285512

(51) Int. Cl.
*B65H 3/14* (2006.01)

(52) U.S. Cl. ..... 271/98; 271/104; 271/105

(58) Field of Classification Search ..... 271/97, 271/98, 104, 105, 106
See application file for complete search history.

(56) References Cited

U.S. PATENT DOCUMENTS 7,540,489 B2 * 6/2009 Kushida ..... 271/98
7,677,553 B2 * 3/2010 Ikeda ..... 271/98

FOREIGN PATENT DOCUMENTS

JP 9-309624 12/1997
JP 2009-227378 10/2009

* cited by examiner

*Primary Examiner* — David H Bollinger
(74) *Attorney, Agent, or Firm* — Finnegan, Henderson, Farabow, Garrett & Dunner, L.L.P.

(57) ABSTRACT

A sheet feeding device includes: a leading edge contacting section having a leading edge contacting surface with which a leading edge side in a sheet conveyance direction of sheets stored in a sheet storage section, comes in contact; a blowing section having an air outlet which blows air to float the sheets from a side surface perpendicular to the conveyance direction of the sheets stored; a sucking and conveying section provided at an upward position over the sheet storing section, which sucks the sheet floated by the air from the blowing section, and conveys the sheet over an upper end of the leading edge contacting section; and a rise prevention member provided on a side of the sucking and conveying section, which comes in contact with the sheet floated by the air from the blowing section and prevents a contacting portion of the floated sheet from being risen.

6 Claims, 8 Drawing Sheets

AIR SHEET FEEDING DEVICE AND IMAGE FORMING SYSTEM HAVING IMAGE FORMING APPARATUS TO WHICH THE AIR SHEET FEEDING DEVICE IS CONNECTED

This application is based on Japanese Patent Application No. 2010-285512 filed on Dec. 22, 2010, which is incorporated hereinto by reference.

BACKGROUND OF THE INVENTION

The present invention relates to a sheet feeding device having an air sheet feeding device for feeding a sheet by sucking the sheet by the suction force of air, and an image forming system including the aforementioned sheet feeding device connected to an image forming apparatus.

There is a sheet feeding device that connects to such an image forming apparatus for forming an image on a sheet as a photocopier or a laser beam printer and supplies a sheet to the image forming apparatus.

The sheet feeding device has a sheet storage section for storing a great number of sheets. Synchronized with the image forming operation of the image forming apparatus, the sheet feeding device feeds out sheets one by one to the image forming apparatus. If a sheet is not picked up from the sheet storage section, a feeding error occurs. Also, if a number of sheets are picked up in one operation, a multiple sheet feed occurs, with the result that a paper jam or similar failure occurs.

One of the techniques known in the conventional art is a sheet feeding device (hereinafter referred to as "air sheet feeding device"), wherein, when sheets are picked up from the sheet storage section one by one and are supplied to the image forming apparatus, the suction force of air is used to make the sheets to be sucked on a conveyance belt, which are then conveyed driven by the conveyance belt.

The conventionally known roller sheet feed device using the frictional force of an elastic roller such as a rubber roller has a disadvantage in that its conveying force greatly depends on the chronological deterioration of the elastic roller, foreign substances attached to the surface of the elastic roller, or properties of the sheets to be conveyed. By contrast, the air sheet feeding device has an advantage in that stable conveying force can be maintained for a long period of time regardless of the sheet properties.

In the air sheet feeding device, air is blown from the periphery side of the sheets stored in the sheet storage section. The air blown from the periphery side makes its way into the gap between sheets to float and separate the sheets. Then, the floated sheet at the topmost position made to be sucked on the conveyance belt arranged above the sheet storage section and conveyed, so that sheets stored in the sheet storage section are picked up one by one and are conveyed.

One of the proposals made in recent years is an air sheet feeding device wherein air is blown from the forward position in the conveyance direction of the sheet stored in the sheet storage section and from the side perpendicular to the conveyance direction (side in the direction of width) so that the sheet stored in the sheet storage section is floated (refer to Japanese Patent Application Publication No. 2009-227378).

Incidentally, a curl may occur to the sheet. If the sheet absorbs moisture, dimensions will increase. If a moistened sheet is placed in an environment of low humidity, the moisture content is discharged and the sheet shrinks. If discharge of moisture is not uniform, the sheet will be deformed without uniform shrinkage, and will be curled.

If the sheets stored in the sheet storage section are curled and air is blown to the sheets, air fails to proceed between sheets, with the result that successful floating and separation of the sheets cannot be achieved.

Another proposal made in recent years is an air sheet feeding device wherein, when the sheets stored in the sheet storage section have their leading edges curled upward or downward in the conveyance direction, pressure is applied to the sides of the sheets stored in the sheet storage section so that the curl on the leading edges in the conveyance direction is corrected, and sheets can be floated and separated successfully (Japanese Patent Application Publication No. H09-309624).

The air sheet feeding device disclosed in the Japanese Patent Application Publication No. H09-309624 operates in the following manner to pick up the sheets stored in the sheet storage section and feeds these sheets one by one.

In the first place, pressure is applied to the sheets stored in the sheet storage section by a pressure means to form a curl where the cross section perpendicular to the sheet conveyance direction is convexed upward. By forming such a curl where the cross section perpendicular to the conveyance direction is convexed upward, the upward or downward curl on the side of the leading edge of the conveyance direction is corrected.

This is followed by the step of blowing air from the leading edge side of the sheet in the conveyance direction. Since the curl that was present on the side of leading edge in the conveyance direction has been corrected, the leading edge of the sheet is kept in parallel with air flow. This makes easy for air to come between sheets, with the result that sheets are floated.

Then, the topmost sheet out of the floated sheets is made to be sucked on the conveyance belt. After the pressure applied by the pressure means has been released, the sheet is conveyed.

In the air sheet feeding device proposed in the Japanese Patent Application Publication No. H09-309624 characterized by the aforementioned operation principle, pressure is applied to the sheets stored in the sheet storage section by a pressure means to ensure that the sheets stored in the sheet storage section will form a curl where the cross section perpendicular to the sheet conveyance direction is convexed upward. This causes a close adherence between sheets. Thus, the air flow for floating fails to enter the gap between sheets sufficiently, and floating of the sheets is practically difficult. It is also practically difficult to make the sheets pressed by the pressure means to be sucked on the conveyance belt. Further, a complicated structure must be designed because the pressure means has to be provided with a moving mechanism for pressing and separating the sheets.

In the air sheet feeding device disclosed in the Japanese Patent Application Publication No. 2009-227378, by contrast, air is blown from the side perpendicular to the conveyance direction (side in the direction of width). This makes it possible to float the sheets curled in such a way that the leading edge of the sheets in the conveyance direction is curled upward or downward, independently of the effect of the curl, when the sheets stored in the sheet storage section are to be floated. However, when the sheets stored in the sheet storage section is convexed downwardly in the direction perpendicular to sheet feed, the sheets are made to float easily by the air blown from the side (side in the direction of width). Thus, a plurality of sheets will be floated, with the result that a plurality of sheets, together with the floating topmost sheet, may be adhered to the conveyance belt and may be conveyed together.

The object of the present invention is to provide a sheet feeding device provided with an air sheet feeding device of simple structure capable of picking up sheets one by one with certainty and conveying these sheets, without being affected by a curl of sheets stored in the sheet storage section.

SUMMARY OF THE INVENTION

The object of the present invention can be achieved by any one of the following aspects.

1. To achieve at least one of the above-mentioned objects, a sheet feeding device reflecting one aspect of the present invention, includes: a sheet storage section for storing sheets; a leading edge contacting section having a leading edge contacting surface contacting the leading edge in the conveyance direction of the sheets stored in the sheet storage section; a blowing section having an air outlet for blowing air for floating a sheet from the side perpendicular to the conveyance direction of the sheets stored in the sheet storage section; a sucking and conveying section located above the sheet storage section to suck the sheet floated by air from the blowing section and to convey the sheet across the upper end of the leading edge contacting portion; and a rise prevention member provided on the side of the sucking and conveying section to contact the sheet to be floated by the air blown from the blowing section and to prevent rise of the contacting portion of the sheet concerned.

2. In the sheet feeding device of above Item 1, the height of the portion of the rise prevention member contacting the sheet is preferably lower than that of the top end of the leading edge contacting portion.

3. In the sheet feeding device described in above Item 1, the rise prevention member is preferably located upstream of the leading edge contacting surface in the sheet conveyance direction and downstream of the air outlet.

4. In the sheet feeding device described in above Item 2, the portion opposed to the sheet floated by the air blown from the blowing section in the rise prevention member is preferably so sloped as to be lowered as one goes farther from the vicinity of the sucking and conveying section.

5. In an image forming system having a configuration where an image forming apparatus for forming an image on a sheet is connected to a sheet feeding device for conveying the sheet to the image forming apparatus, the sheet feeding device includes:

a sheet storage section for storing sheets; a leading edge contacting portion having a leading edge contacting surface contacting the leading edge of the sheets stored in the sheet storage section in the conveyance direction; a blowing section having an air outlet for blowing air to float the sheet from the side perpendicular to the conveyance direction of the sheets stored in the sheet storage section; a sucking and conveying section located above the sheet storage section to suck the sheet floated by the air from the blowing section and to convey the sheet across the top end of the leading edge contacting portion; and a rise prevention member located on the side of the sucking and conveying section to contact the sheet floated by air from the blowing section and to prevent the rise of the portion contacted by the sheet.

6. In the image forming system described in above Item 5, the height of the portion contacting the sheet in the rise prevention member is preferably lower than that of the top end of the leading edge contacting portion.

7. In the image forming system described in above Item 5, the rise prevention member is preferably located upstream of the leading edge contacting surface in the sheet conveyance direction and downstream of the air outlet in the sheet conveyance direction.

8. In the image forming system described in above Item 6, the portion opposed to the sheet to be floated by the air blown from the blowing section in the rise prevention member preferably has an inclination which becomes lower as one goes farther from the vicinity of the sucking and conveying section.

DETAILED DESCRIPTION OF THE PREFERRED EMBODIMENT

Figure 1:
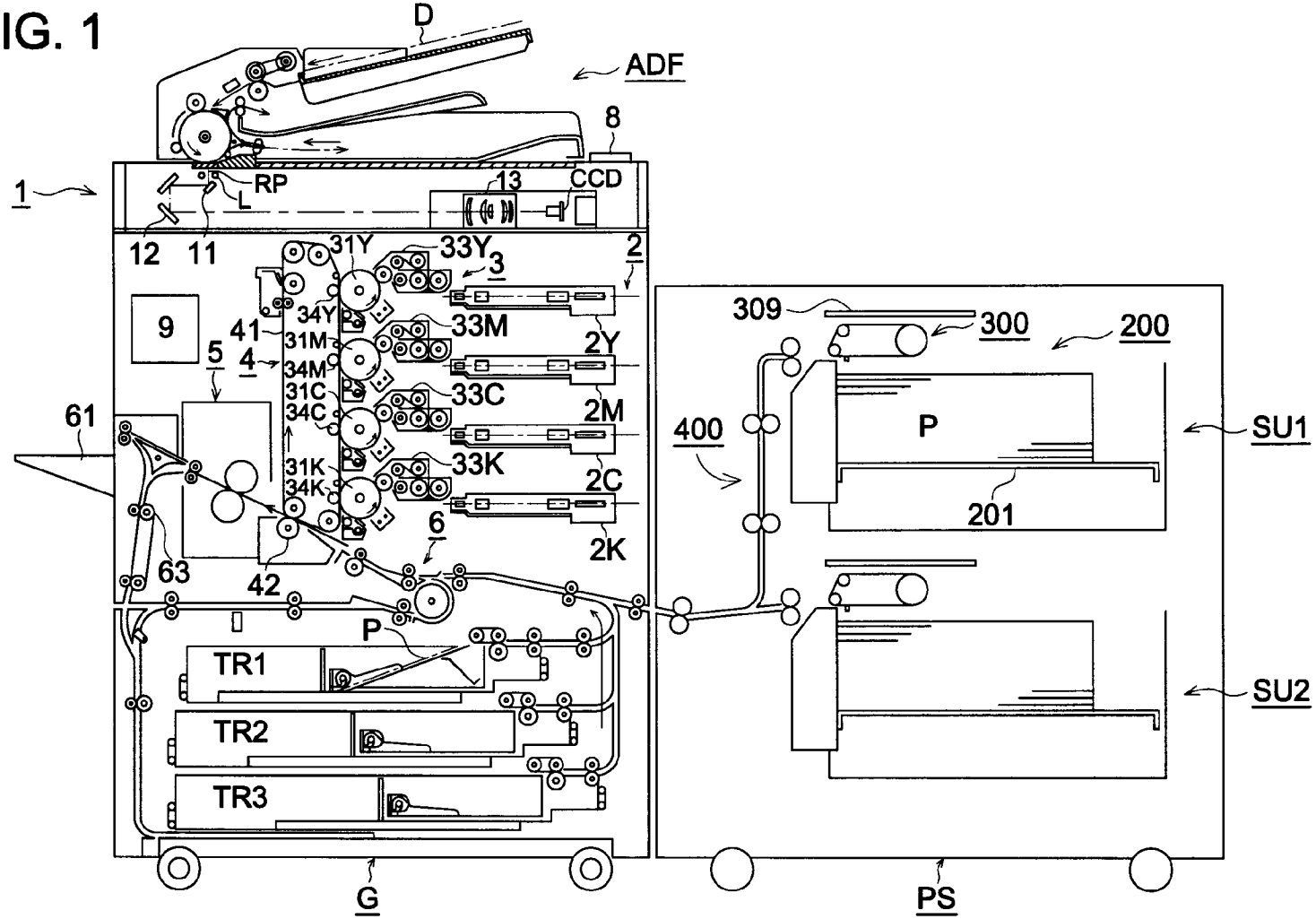
FIG. 1 is a diagram representing an image forming system formed by connection between the sheet feeding device PS as an example of the embodiment of the present invention and an image forming apparatus G.

FIG. 1 is a diagram representing an image forming system formed by connection between the sheet feeding device PS as an example of the embodiment of the present invention and an image forming apparatus G.

In the illustrated image forming system, the sheet feeding device PS feeds the stored sheets to the image forming apparatus G. The image forming apparatus G forms an image on the sheets received from the sheet feeding device PS and ejects these sheets out of the machine.

The image forming apparatus G is a so-called tandem type color image forming apparatus wherein a plurality of photoreceptors 31Y, 31M, 31C, and 31K (hereinafter also referred to as "31Y, M, C, K") are placed face to face with the intermediate transfer belt 41, and are arranged in the vertical direction so that a full-color image is formed.

The image forming apparatus has an automatic document feeder (ADF) mounted on its top.

The automatic document feeder ADF feeds the documents D placed on the document stacking table one by one to the document image reading position of the image forming apparatus G.

The image forming apparatus G includes a document reading section 1, exposing section 2, image forming section 3, intermediate transfer section 4, fixing section 5, sheet conveyance section 6, operation and display section 8, and controller 9. These components are incorporated in one frame.

The document reading section 1 allows the document image to be exposed to the lamp L at the document reading position RP. The reflecting light thereof is led by the first mirror unit 11, second mirror unit 12 and lens 13, so that the image is formed on the light receiving surface of the image pickup element CCD.

The image signal subjected to photoelectric conversion by the image pickup element CCD is subjected to A/D conversion, shading correction and compression by the image reading controller, and is stored in the memory of the controller 9 as image data.

The image data stored in the memory is subjected to appropriate image processing under the conditions preset by the user and the output image data is generated.

The exposing section 2 has exposing units 2Y, 2M, 2C and 2K that apply laser beams corresponding to the four colors of Y (yellow), M (magenta), C (Cyan) and K (Black) based on the output image data. Each of the exposing units 2Y, 2M, 2C and 2K has a laser beam source, a polygon mirror and a plurality of lenses, and generates laser beams in response to the output image data.

The image forming section 3 is provided with image forming units 3Y, 3M, 3C and 3K corresponding to the four colors of Y (yellow), M (magenta), C (Cyan) and K (Black). Each of the image forming units 3Y, 3M, 3C and 3K has photoreceptors 31Y, M, C, K, developing sections 33Y, M, C, K, and the primary transfer rollers 34Y, 34M, 34C and 34K.

Laser beams corresponding to four colors of Y (yellow) M (magenta), C (Cyan) and K (Black) are applied to the photoreceptors 31Y, M, C, K of the image forming units 3Y, M, C, K respectively from the exposing units 2Y, M, C, K of the exposing section 2, so that a latent image is formed on each photoreceptor.

The latent images on the photoreceptors 31Y, M, C, K are developed by the corresponding developing sections 33Y, 33M, 33C and 33K respectively, so that toner images of Y (yellow) M (magenta), C (Cyan) and K (Black) are created.

The toner images funned on the photoreceptors 31Y, M, C, K are sequentially transferred to prescribed positions of the intermediate transfer belt 41 as the intermediate transfer member by the primary transfer rollers 34Y, M, C, K through the intermediate transfer section 4, so that color toner images are formed on the intermediate transfer belt 41.

The sheet conveyance section 6 has a plurality of conveyance rollers and a guide member, and conveys the sheets stored in the sheet feeding trays TR1, TR2 and TR3, or the sheets received from the sheet feeding device PS to a prescribed position inside the image forming apparatus G at prescribed time intervals.

The color toner image formed on the intermediate transfer belt 41 is transferred by the secondary transfer roller 42 as a transfer section onto the sheet P conveyed by the sheet conveyance section 6.

The sheet P with the toner image transferred thereon is conveyed to the fixing section 5 by the sheet conveyance section 6, and is pressed and heated by a rotary body such as oppositely rotating rollers or belts until the toner image is fixed onto the sheet P.

The sheet P subjected to the process of fixing by the fixing section 5 is ejected to the sheet ejection table 61 by the sheet conveyance section 6.

The operation and display section 8 has a touch panel where a touch screen is placed on the display section composed of a liquid crystal panel. The operation and display section 8 displays various operation screens and is used to input the conditions of the sheet in the job to be executed by the image forming system, such as the size, the number of sheets, and whether to use the sheet stored in the image forming apparatus G or whether to use the sheet stored in the sheet feeding device PS.

The reference numeral 9 in the figure denotes a controller. The controller 9 forms an image by controlling the operations of various components of the image forming apparatus G, based on the job conditions inputted from the operation and display section 8, and allows the image forming apparatus G to supply the sheet P to the sheet feeding device PS according to the job conditions.

The illustrated sheet feeding device PS includes two sheet feeding units SU1 and SU2 having one and the same structure, and a sheet conveyance section 400. In the following description, the sheet feeding units SU1 and SU2 having one and the same structure will be collectively referred to as a sheet feeding unit SU, except when distinction between the two is essential.

The sheet feeding unit SU is provided with a sheet storage section 200 and a sucking and conveying section 300.

The sheet storage section 200 has a sheet stacking table 201, and sheets P are stacked and stored on the upper surface of the sheet stacking table 201.

The sucking and conveying section 300 is suspended and held in the space above the sheet storage section 200 by a sucking and conveying section supporting plate 309 fixed on the frame of the sheet feeding unit SU.

The sucking and conveying section 300 has a motor-driven fan and a motor-driven belt. As the fan and belt are driven, the sheets P stored in the sheet storage section 200 are sucked on the belt one by one, and are fed out to the sheet conveyance section 400.

The sheet conveyance section 400 has a sheet conveyance path and a plurality of motor-driven rollers. The sheets P fed from the sheet feeding unit SU is fed out to the image forming apparatus G by the sheet conveyance section 400.

The number of the sheet feeding units SU to be arranged need not always be two. One or three sheet feeding units SUs can be used.

When a plurality of sheet feeding units SU is provided, sheets of different size and paper type can be stored in different sheet storage sections 200.

Figure 2:
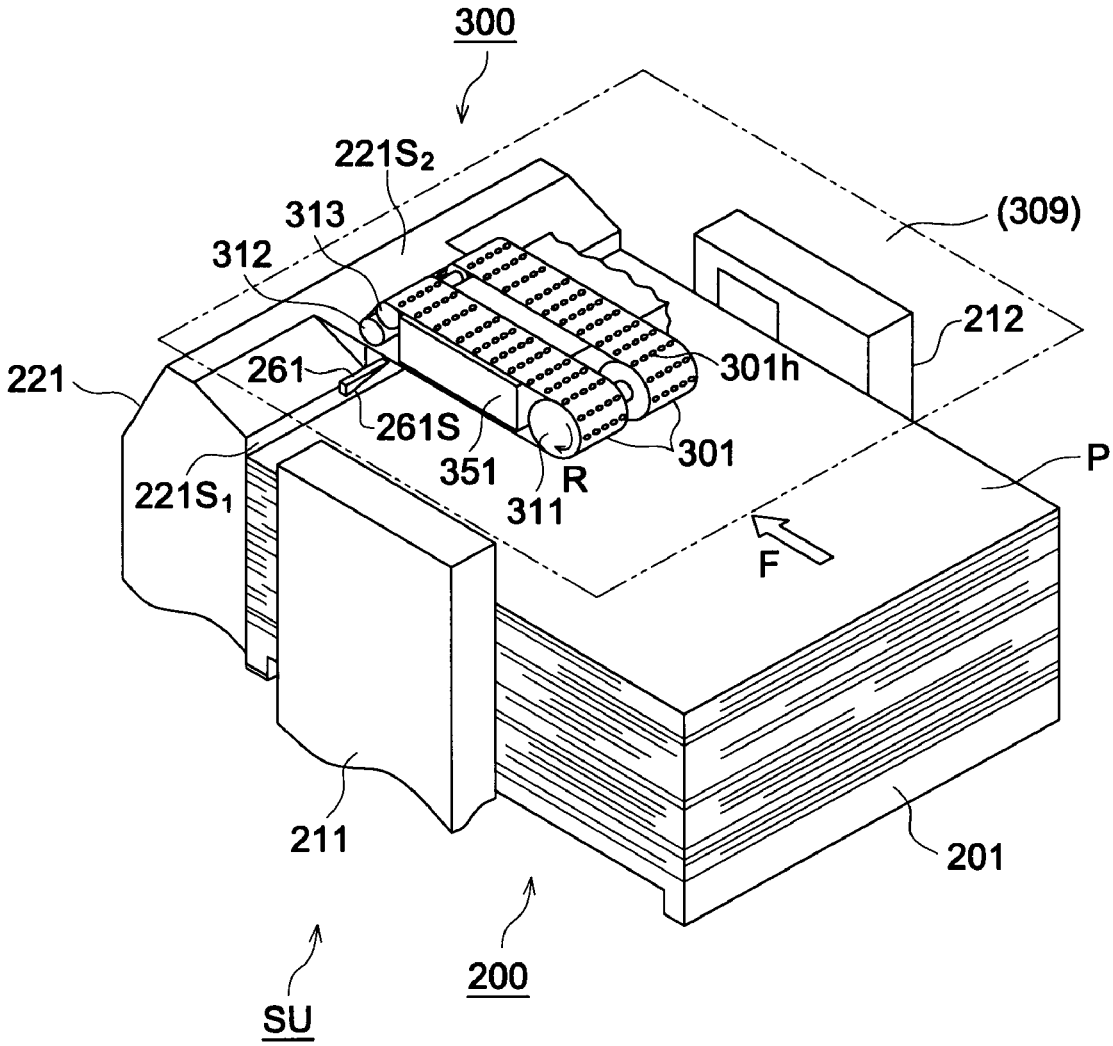
FIG. 2 is a conceptual diagram of a sheet feeding unit SU.

FIG. 2 is a conceptual diagram of a sheet feeding unit SU.

The sheet feeding unit SU is provided with a sheet storage section 200 for storing sheets, and a sucking and conveying section 300. The sucking and conveying section 300 is held in a suspended form by a sucking and conveying section supporting plate 309 through a suspension member (not illustrated) in the space above the sheet storage section 200. Further, in a symmetric position with the sucking and conveying section 300 located in-between, a rise prevention member (A) 261 and a rise prevention member (B) 262 are held in a suspended form by a sucking and conveying section supporting plate 309 through a suspension member (not illustrated) in the space above the sheet storage section 200. FIG. 2 shows only the rise prevention member (A) 261 located on the front side of the sucking and conveying section 300. FIG. 2 does not show the rise prevention member (B) 262 located on the back of the sucking and conveying section 300.

The sheet storage section 200 has a sheet stacking table 201 to stack sheets P thereon, side guides 211 and 212, and leading edge contacting portion 221. The side guides 211 and 212 are arranged in a symmetric form with the contacting sheet held in-between. The leading edge contacting portion 221 has a top surface $221S_2$ and leading edge contacting surface $221S_1$.

In the sheets stored in the sheet storage section 200, the leading edge on the downstream side in the conveyance direction is made to contact the leading edge contacting surface 221$S_1$ of the leading edge contacting portion 221 and, at the same time, both ends of these sheets are made to contact the side guides 211 and 212. After that, these sheets are stacked on the sheet stacking table 201. A plurality of sheets can be stacked on the sheet stacking table 201. A sheet stacking table elevation mechanism (not illustrated) is provided to ensure that the distance from the topmost sheet P of the sheets P placed on the sheet stacking table 201 to the bottom surface of the conveyance belt 301 in the sucking and conveying section 300 is kept within a prescribed range.

The sucking and conveying section 300 includes two conveyance belts 301 having one and the same structure, a drive roller 311, a driven roller (A) 312, a driven roller (B) 313 and a depressurization chamber 351.

The two conveyance belts 301 are endless belts and are applied to the drive roller 311 and driven roller (A) 312 which are arranged in parallel to the respective shafts.

The depressurization chamber 351 is arranged on the inner periphery of the two conveyance belts 301 applied between rollers. The depressurization chamber 351 is designed in a box-like structure having an opening on the side opposed to the sheet storage section 200 (lower side in the illustration). The internal space thereof is depressurized by the operation of the suction fan 351F (shown in FIG. 4).

All the surfaces of the conveyance belt 301 are provided with a plurality of vent holes 301*h* penetrating the belt from the surface to the back. Air flow for sucking sheets P toward the depressurization chamber 351 is generated by the reduction of pressure in the depressurization chamber 351 through the vent hole 301*h* of the conveyance belt 301 opposed to the opening of the depressurization chamber 351. This air flow allows the sheets to be sucked on the conveyance belt 301.

The drive roller 311 is driven by the drive motor 311M (not illustrated) as a drive source, and is rotated in the direction shown by arrow R.

The two conveyance belts 301 applied to the drive roller 311, driven roller A312 and driven roller B313 convey in the direction shown by arrow F the sheets P sucked by rotation of the drive roller 311 in the direction shown by arrow R. The sheet conveyance direction, namely, the direction shown by arrow F is called the sheet conveyance direction. The side to which the arrow is directed is called the downstream side in the conveyance direction and the opposite side is called the upstream side in the conveyance direction.

The height of the conveyance belt 301 and the shape and height of the leading edge contacting portion 221 are designed in such a way that the sheets sucked on the conveyance belt 301 are conveyed in the arrow-marked direction without being interfered by the leading edge contacting surface 221$S_1$.

The sheets sucked on the conveyance belt 301 and conveyed in the arrow-marked direction are fed above the top surface 221$S_2$ of the leading edge contacting portion 221 to reach the sheet conveyance section 400 (see FIG. 4) arranged downstream of the leading edge contacting portion 221 in the sheet conveyance direction. The sheets P are then fed to the image forming apparatus G by the sheet conveyance section 400.

Air is blown to the sheets P stacked on the sheet stacking table 201 from the side guides 211 and 212. The sheets P located at higher positions of the sheet stacking table 201 are floated by the air blown from the side guides 211 and 212, and are sucked on the conveyance belt 301 with certainty.

The rise prevention member (A) 261 and rise prevention member (B) 262 contact the floating sheets and regulate the rise of the contacting portions of the sheets. Of the floating sheets, only the topmost sheet is sucked on the conveyance belt 301. The operation of the rise prevention member (A) 261 and rise prevention member (B) 262 will be described later.

Figure 3:
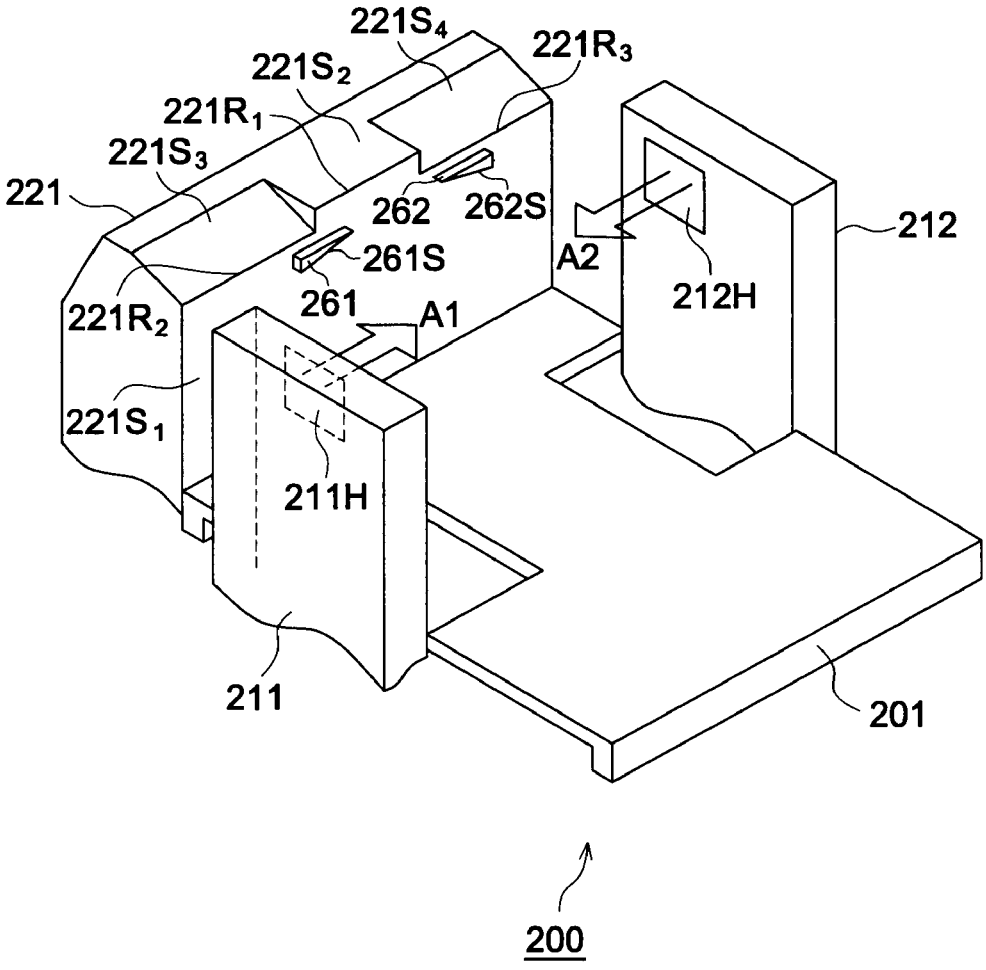
FIG. 3 is a diagram showing a rise prevention member (A) 261, rise prevention member (B) 262 and surrounding area thereof.

FIG. 3 is a diagram showing a rise prevention member (A) 261, rise prevention member (B) 262 and surrounding area thereof. In FIG. 3, the sheets P placed on the sucking and conveying section 300 and sheet stacking table 201 are excluded from the sheet feeding unit SU of FIG. 2.

The sheet stacking table 201 has a notched section. The side guides 211 and 212 are designed to move along the notch of the sheet stacking table 201 to come closer or farther from each other. By the movement of the side guides 212 and 212 to come closer or farther from each other, the lateral end of the sheet can be contacted even when the sheets of different sizes are placed on the sheet stacking table 201.

The side guide 212 is provided with a floating air outlet 212H. An air flow A2 is sent from the floating air outlet 212H. Similarly, the side guide 211 is provided with a floating air outlet 211H. An air flow A1 is sent from the floating air outlet 211H. Air flows A1 and A2 are sent tote lateral surfaces of the sheets P placed on the sheet stacking table 201 to float the sheets P. Floating of the sheets P ensures the sheets to be sucked by the sucking and conveying section 300. The side guides 211 and 212 serve as a blowing section.

The rise prevention member (A) 261 and rise prevention member (B) 262 are placed in a symmetric position with the sucking and conveying section 300 (not illustrated) placed in-between. The rise prevention member (A) 261 and rise prevention member (B) 262 have the sheet contacting surfaces 261S and 262S that contact oppositely the sheets floated by the air blown from the side guides 211 and 212, respectively.

The sheet contacting surface 261S in the rise prevention member (A) 261 is so sloped as to be lowered as one goes from the sucking and conveying section 300 toward the side guide 211, namely, as one goes farther away from the sucking and conveying section 300. Similarly, the sheet contacting surface 262S in the rise prevention member (B) 262 is sloped and lowered as one goes from the sucking and conveying section 300 toward the side guide 211, namely, as one goes farther away from the sucking and conveying section 300. The sheet contacting surfaces 261S and 262S are preferably designed to have a smooth and elastic structure.

The sheet contacting surfaces 261S and 262S are structured in relation to the height of the leading edge contacting portion 221.

The top surface 221$S_2$ and leading edge contacting surface 221$S_1$ in the leading edge contacting portion 221 are connected directly at the center and through the intermediary of slanted portions 221$S_3$ and 221$S_4$ on both sides. The reference numeral 221R1 in the reference data denotes the edge line formed on the connection between the top surface 221$S_2$ and leading edge contacting surface 221$S_1$, the 221R2 denotes the edge line formed on the connection between the top surface 221$S_3$ and leading edge contacting surface 221$S_1$, and the reference numeral 221R3 denotes the edge line formed on the connection between the top surface 221$S_4$ and leading edge contacting surface 221$S_1$. The slanted portion 221$S_3$ and slanted portion 221$S_4$ are formed to ensure that both the edge lines 221R2 and 221R3 are horizontal and are flush with each other.

The sheet contacting surfaces 261S and 262S are structured to be lower than the horizontal surface including the edge line 221R1, and higher than the horizontal surface including the edge lines 221R2 and 221R3.

Figure 4:
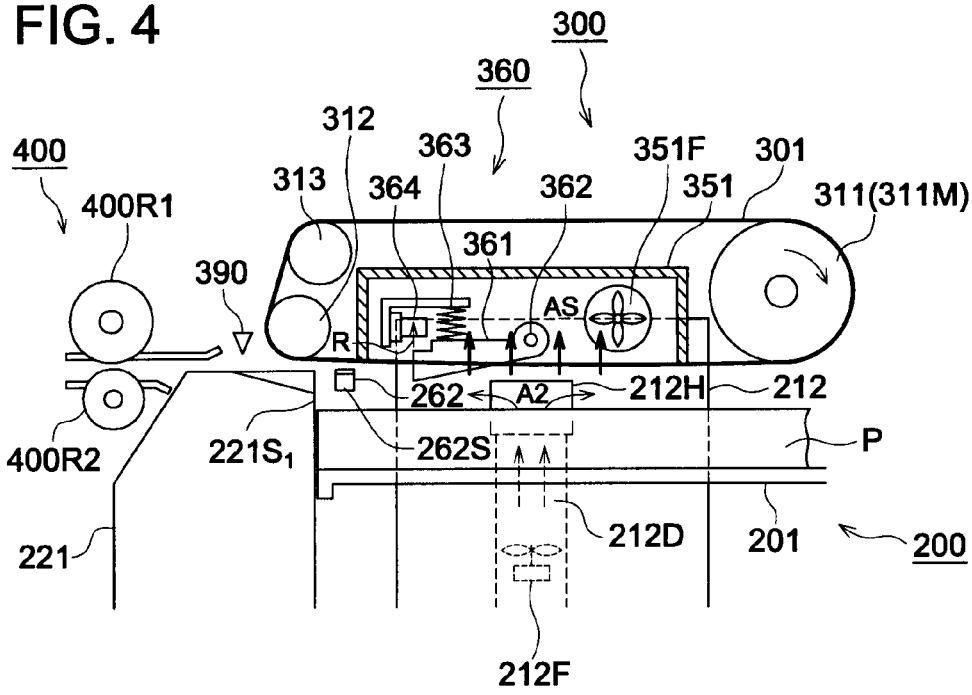
FIG. 4 is a partially cross sectional view of the sheet feeding unit SU taken along the line between two parallel conveyance belts 301 in the conveyance direction of a sheet P.

FIG. 4 is a partially cross sectional view of the sheet feeding unit SU taken along the line between two parallel conveyance belts 301 in the conveyance direction of a sheet P.

The side guide 212 has a floating air outlet 212H for blowing out floating air. The floating air outlet 212H is an opening of the duct 212D connected to the side guide 212. The duct 212D is equipped with a blower fan 212F. The blower fan 212F is a fan unit where a motor and a fan driven by the motor to send air in a prescribed direction are integrated into one. The air flow A2 formed by rotation of the blower fan 212F is sent from the floating air outlet 212H to the lateral surfaces of the sheets P placed on the sheet stacking table 201. The control of the operation of the blower fan 212F will be described later.

Similarly, the side guide 211 (not illustrated in FIG. 4) arranged on the front with the sheets P located in-between also has a duct 211D, blower fan 211F, and floating air outlet 211H. Air flow A1 formed by rotation of the blower fan 211F is sent from the floating air outlet 211H toward the lateral surfaces of the sheets P placed on the sheet stacking table 201. The control of the operation of the blower fan 211F will be described later.

The sucking and conveying section 300 is provide with a conveyance belt 301, drive roller 311, driven roller (A) 312, driven roller (B) 313 and depressurization chamber 351, as well as an adhesion detection section 360. The drive roller 311 is driven by the rotation of the drive motor 311M. The control of the operation of the drive motor 311M will be described later.

The depressurization chamber 351 is equipped with a suction fan 351F, which sucks air from inside the depressurization chamber 351 to reduce the pressure in the internal space of the depressurization chamber. The suction fan 351F is a fan unit where a motor and a fan driven by the motor to suck air in a prescribed direction are integrated into one. The control of the operation of the suction fan 351F will be described later.

Reduction of pressure in the depressurization chamber 351 generates the air flow AS that sucks sheets P toward the depressurization chamber 351 through the vent hole 301*h* of the conveyance belt 301 opposed to the opening of the depressurization chamber 351. This air flow AS causes sheets P to be sucked on the conveyance belt 301.

The adhesion detection section 360 is located between two conveyance belts 301 installed in parallel to each other, and is used to detect presence or absence of a sheet P sucked on the conveyance belt 301.

The adhesion detection section 360 has an adhesion detection lever 361, spring 363, and lever sensor 364. The adhesion detection lever 361 is arranged rotatably about the shaft 362, and is biased by the spring 363 to rotate about the axis 362 in the counterclockwise direction.

In the illustrated adhesion detection section 360, the sheet P is not sucked on the conveyance belt 301. The tip end of the adhesion detection lever 361 biased by the spring 363 projects downward from the bottom end of the conveyance belt 301 between two conveyance belts 301. Under this condition, there is no output from the lever sensor 364.

In the meantime, when the sheet P is sucked on the conveyance belt 301, the tip and of the adhesion detection lever 361 contacts the sheet P sucked on the conveyance belt 301, and is turned in the arrow-marked direction against the biasing force of the spring 363. When the sheet P has been sucked on the conveyance belt 301, the output of the lever sensor 364 is turned on.

Thus, from the output of the lever sensor 364, it is possible to determine whether or not the sheet P has been sucked on the conveyance belt 301.

Air flows A1 (see FIG. 3) and A2 are blown to the sheets P stacked on the sheet stacking table 201 so that the sheets at higher positions are floated. These sheets are sucked toward the depressurization chamber 351 provided on the inner periphery of the conveyance belt 301 of the sucking and conveying section 300 through the vent hole 301*h* of the conveyance belt 301, and adheres to the conveyance belt 301.

The rise prevention member (B) 262 is arranged upstream of the leading edge contacting surface 221$S_1$ in the leading edge contacting portion 221 in the sheet conveyance direction and downstream of the floating air outlet 212H blowing out air for floating the sheet from the side, in the sheet conveyance direction. Similarly, although not illustrated in FIG. 4, the rise prevention member (A) 261 arranged on the illustrated front of the rise prevention member (B) 262 is also arranged upstream of the leading edge contacting surface 221$S_1$ in the leading edge contacting portion 221 in the sheet conveyance direction and downstream of the floating air outlet 211H (not illustrated in FIG. 4) blowing out air for floating the sheet from the side, in the sheet conveyance direction. The rise prevention member (B) 262, together with the rise prevention member (A) 261, allows the topmost one of the sheets floated by the air flows A2 and A1 to be sucked on the conveyance belt 301. The operations of the rise prevention member (A) 261 and rise prevention member (B) 262 will be described later.

When the sheet has been sucked on the conveyance belt 301 and the output of the lever sensor 364 has been turned on, the drive motor 311M starts to drive the conveyance belt 301.

Driven by the conveyance belt 301, the sheet P sucked on the conveyance belt 301 is conveyed, passing over the leading edge contacting portion 221, to the sheet conveyance section 400.

The outlet of the sheet feeding unit SU is provided with a sheet sensor 390. When the sheet P being conveyed is detected by the sheet sensor 390, the OFF state is changed to the ON state. The reference numerals 400R1 and 400R2 in FIG. 4 indicate an inlet conveyance roller and an inlet driven roller arranged at the inlet of the sheet conveyance section 400, respectively. The inlet conveyance roller 400R1 is driven and rotated by a motor (not illustrated). The inlet conveyance roller 400R1 and inlet driven roller 400R2 sandwich the sheet P conveyed from the sheet feeding unit SU to the sheet conveyance section 400, and feed the sheet out to the sheet conveyance path of the sheet conveyance section 400.

The sheet P fed out to the sheet the sheet conveyance path is conveyed to the image forming apparatus G so that an image is formed.

Figure 5:
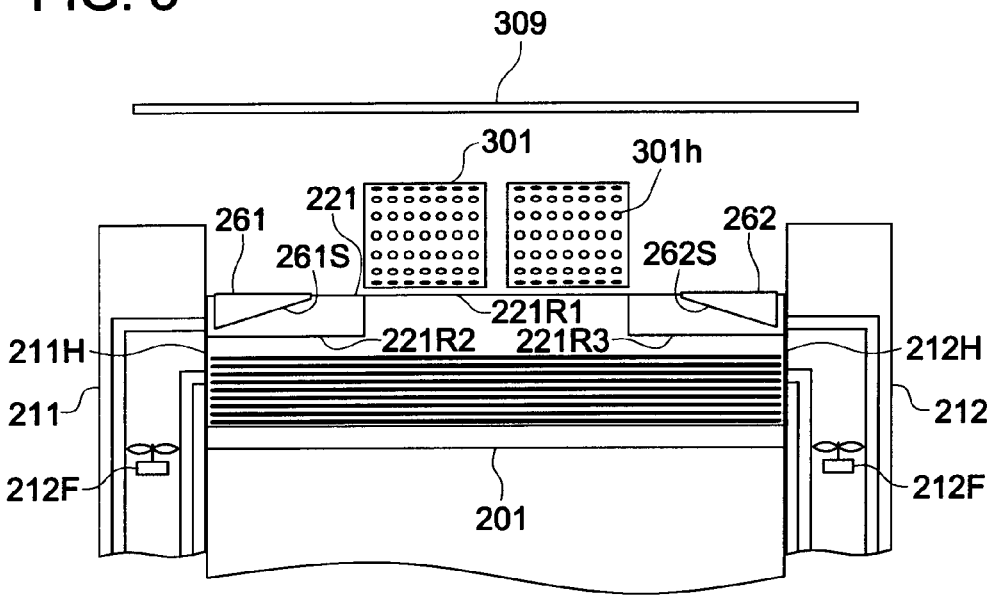
FIG. 5 is a diagram showing the layout positions of a rise prevention member (A) 261 and rise prevention member (B) 262.

FIG. 5 is a diagram showing the layout positions of a rise prevention member (A) 261 and rise prevention member (B) 262. FIG. 5 is a partial side view of the sheet feeding unit SU of FIG. 1 as viewed from the right.

As described above, at a symmetric position sandwiching two conveyance belts 301 of the sucking and conveying section 300, the rise prevention member (A) 261 and rise prevention member (B) 262 are held in a suspended form by the sucking and conveying section supporting plate 309 through a suspension member (not illustrated). The sheet contacting surfaces 261S and 262S are provided in such a way as to be lower than the horizontal surface including the edge line 221R1 of the leading edge contacting portion 221, and higher than the horizontal surface including the edge lines 221R2 and 221R3 of the leading edge contacting portion 221. The sheet sucking surface of the lower illustrated side in the conveyance belt 301 is designed higher than the horizontal surface including the edge line 221R1.

The rise prevention member (A) 261 and rise prevention member (B) 262 contact the sheet floated by the air blown from the floating air outlets 211H and 212H so as to prevent rise of the contacting portion of the sheet and to ensure the floating topmost sheet to be sucked on the conveyance belt 301. The following describes the operations thereof.

FIGS. 6A-6D are diagrams showing the operations of the rise prevention member (A) 261 and rise prevention member (B) 262.

Figure 6A:
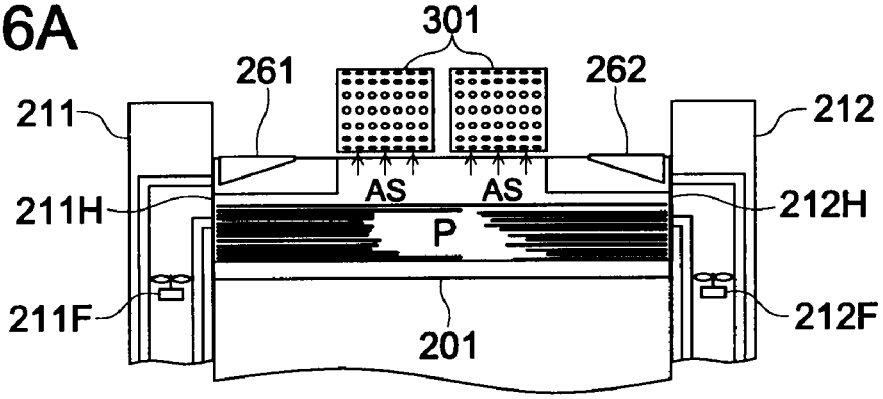
FIGS. 6A-6D are diagrams showing the operations of the rise prevention member (A) 261 and rise prevention member (B) 262.

FIG. 6A shows that the blower fans 211F and 212F are not operating. The air flow AS for attracting the sheet toward the conveyance belt 301 is formed by the operation of the suction fan 351F (not illustrated). However, the sheet P placed on the sheet stacking table 201 is not yet attracted and sucked.

When the blower fans 211F and 212F in the state shown in FIG. 6A have started, air flows A1 and A2 are blown from the floating air outlet 211H and floating air outlet 212H, respectively. The air flows A1 and A2 are blown to the sheets P placed on the sheet stacking table 201 from both illustrated sides to float the sheets placed at higher positions. Then the rise prevention member (A) 261 and rise prevention member (B) 262 contact the floated sheet.

Figure 6B:
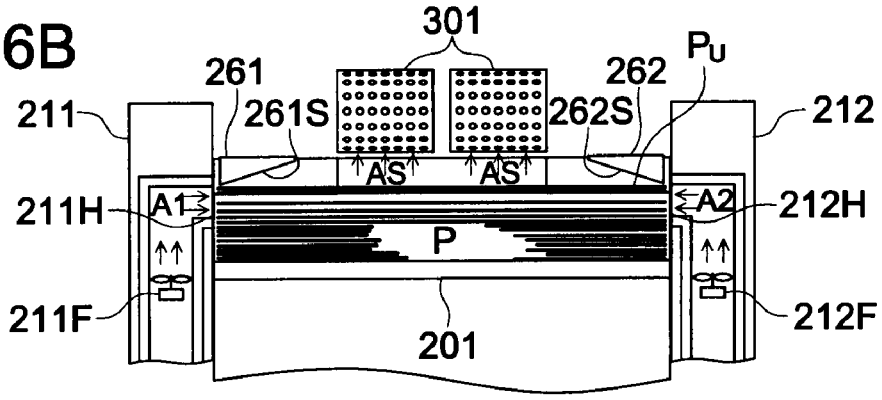

FIG. 6B shows that the rise prevention member (A) 261 and rise prevention member (B) 262 contact the topmost sheet $P_U$ out of a plurality of sheets floated by the air flows A1 and A2. The sheet contacting surfaces 261S and 262S are used when the rise prevention member (A) 261 and rise prevention member (B) 262 contact the topmost sheet $P_U$. The air flow AS attracting sheets toward the conveyance belt 301 works on the topmost sheet $P_U$ contacted by the rise prevention member (A) 261 and rise prevention member (B) 262, and allows the sheet $P_U$ to be sucked on the conveyance belt 301.

Figure 6C:
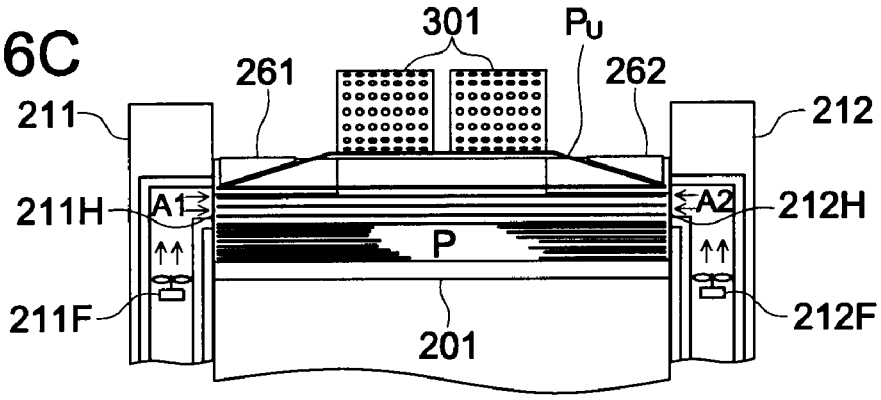

FIG. 6C shows that the topmost sheet $P_U$ is sucked on the conveyance belt 301. As illustrated, in the topmost sheet $P_U$ contacted by the rise prevention member (B) 262 and sucked on the conveyance belt 301, an upwardly convexed curl is formed in the direction perpendicular to sheet feed.

The sheet contacting surfaces 261S and 262S of the rise prevention member (A) 261 and rise prevention member (B) 262, respectively, are so sloped as to be lowered as one goes farther from the vicinity of the conveyance belt 301. The structure of the sheet contacting surfaces 261S and 261S so sloped as to be lowered as one goes farther from the vicinity of the conveyance belt 301 ensures appropriately contacting of the floated sheet to form an upwardly convexed curl, even when the sheets of different sizes are stored and floated.

When the topmost sheet $P_U$ is sucked on the conveyance belt 301, the air flow AS for attracting sheets toward the conveyance belt 301 works on the topmost sheet $P_U$ alone, without working on the sheets at lower positions including the one located immediately below the topmost sheet. Thus, the rise prevention member (B) 262 contacts the sheets at lower positions so that further rise is prevented, and only the topmost sheet $P_U$ is separated from the sheets at lower positions and is sucked on the conveyance belt 301. When the topmost sheet $P_U$ is sucked on the conveyance belt 301, the blower fans 211F and 212F stop operation.

Figure 6D:
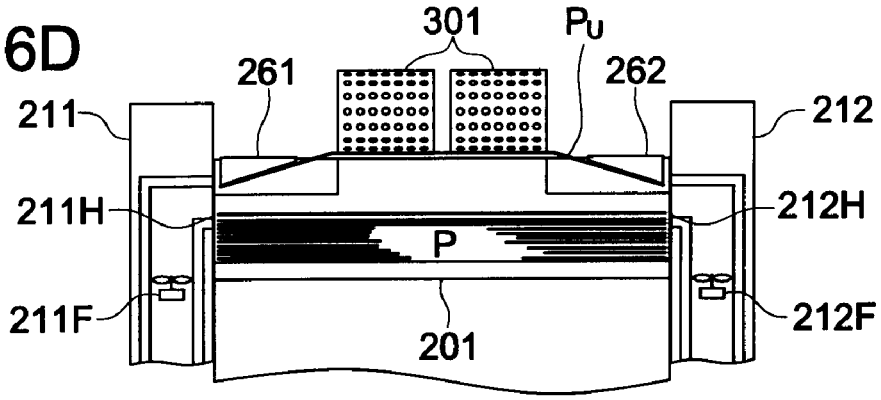

In FIG. 6D, the topmost sheet $P_U$ is sucked on the conveyance belt 301 and the operation of the blower fans 211F and 212F is stopped. Suspension of the operation of the blower fans 211F and 212F causes blowing of the air flows A1 and A2 to be stopped. Then, the floating sheets fall onto the sheet stacking table 201 and are stacked on top of other sheets. Under this condition, the conveyance belt 301 is driven and only the sucked topmost sheet $P_U$ is conveyed toward the leading edge contacting portion 221 shown on the back of the drawing.

The rise prevention member (A) 261 and rise prevention member (B) 262 are structured and laid out so that the respective sheet contacting surfaces 261S and 262S are lower than the horizontal surfaces including the edge line 221R1 and are higher than the horizontal surface including the edge line 221R2 and edge line 221R3. Therefore, the sheet with an upwardly convexed curl formed thereon is fed to the sheet conveyance section 400 along the top surface 221$S_2$ in the leading edge contacting portion 221 and the slanted portions 221$S_3$ and 221$S_4$ and at both ends. The topmost sheet $P_U$ is conveyed by being rubbed by the sheet contacting surfaces 261S and 262S. However, the smooth and elastic structure of the sheet contacting surfaces 261S and 262S reduces the conveyance resistance and eliminates the possibility of a rubbing mark being produced.

As described above, the sheet feeding device PS blows air from the side of the sheet perpendicular to the conveyance direction (side in the direction of width). This ensures floating of the sheet having a curl wherein the leading edge to float the sheets stored in the sheet storage section in the conveyance direction is bent upward or downward, without being affected by the curl. Then, by making the floated sheets contact the rise prevention member (A) 261 and rise prevention member (B) 262, it is possible to make only the topmost sheet to be sucked on the conveyance belt 301 and convey it, eliminating multi-feeding.

Incidentally, when the sheet stored in the sheet storage section 200 has a downwardly convexed curl in the direction perpendicular to sheet feed, the sheet tends to be floated more easily by the air blown from the side (side in the direction of width), and a multiple sheet feed is more likely to occur. However, the rise prevention member (A) 261 and rise prevention member (B) 262 works effectively on such a sheet.

Figure 7A:
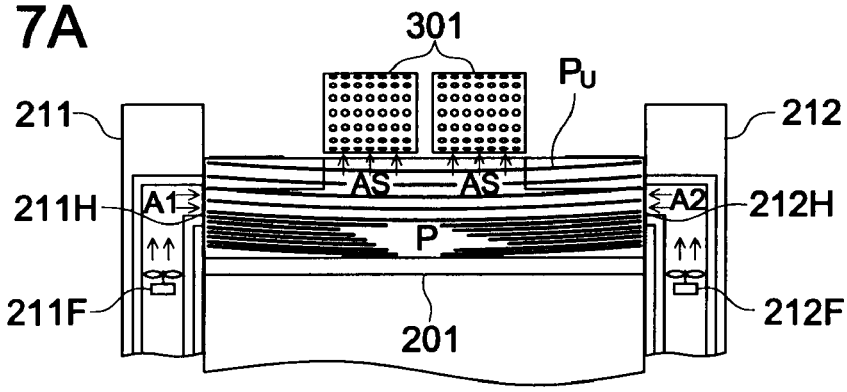
FIGS. 7A-7D are diagrams showing the effects of the rise prevention member (A) 261 and rise prevention member (B) 262.
Figure 7B:
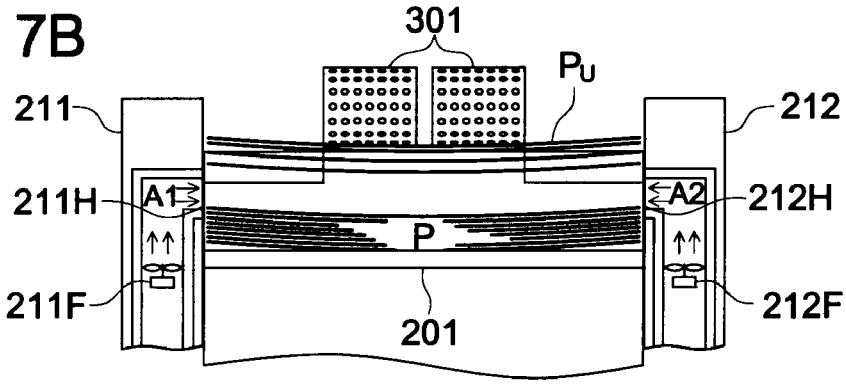
Figure 7C:
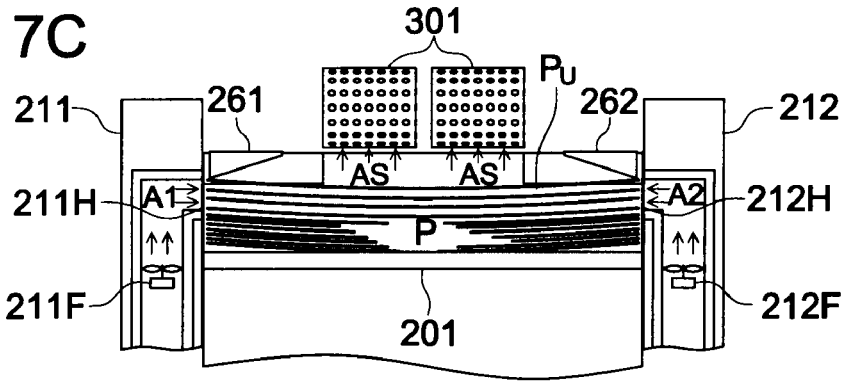
Figure 7D:
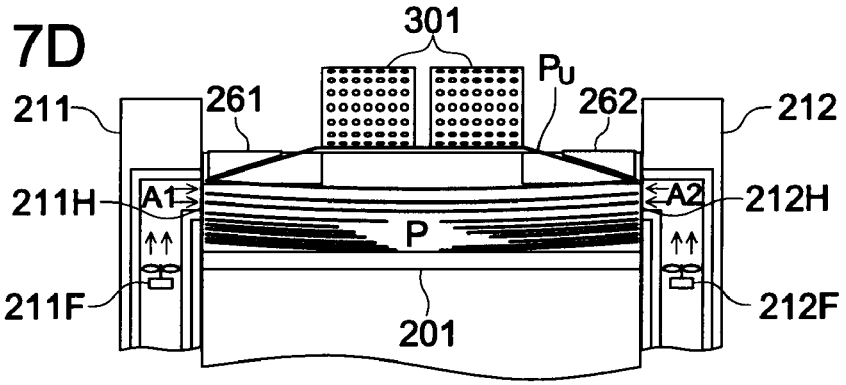

FIGS. 7A-7D are diagrams showing the effects of the rise prevention member (A) 261 and rise prevention member (B) 262. FIGS. 7A and 7B are diagrams showing the sheet sucking operation, wherein the rise prevention member (A) 261 and rise prevention member (B) 262 are excluded from the structure described with reference to FIG. 6A-6D for convenience of explanation. FIGS. 7C and 7D are diagrams showing the sheet sucking operation in the structure having the rise prevention member (A) 261 and rise prevention member (B) 262 explained with reference to FIGS. 6A-6D. In all cases, the sheet placed on the sheet stacking table 201 of the sheet storage section 200 has a downwardly convexed curl in the direction perpendicular to sheet feed.

FIG. 7A is the diagram showing the state corresponding to the aforementioned FIG. 6B in a structure not provided with a rise prevention member (A) 261 and use prevention member (B) 262. To be more specific, FIG. 7A shows that the air flow AS for attracting sheets toward the conveyance belt 301 is formed, the blower fans 211F and 212F are operating and air flows A1 and A2 are coming out of the floating air outlet 211H and floating air outlet 212H, respectively. The air flows A1 and A2 are blown from both the illustrated sides of the sheets P placed on the sheet stacking table 201 so that the sheets located at higher positions are floated. Since the sheets placed on the sheet stacking table 201 have a downwardly convexed curl in the direction perpendicular to sheet feed, they float due to the increased buoyancy given by the air flows A1 and A2 blown from the side thereof. The air flow AS for attracting sheets toward the conveyance belt 301 works on the floating topmost sheet $P_U$ so that the sheet $P_U$ is sucked on the conveyance belt 301.

FIG. 7B shows the state corresponding to the aforementioned FIG. 6C. To be more specific, this diagram shows that the floated topmost sheet $P_U$ is sucked on the conveyance belt 301.

When the topmost sheet $P_U$ is sucked on the conveyance belt 301, the air flow AS for attracting sheets toward the conveyance belt 301 works on the topmost sheet $P_U$ alone, not on the lower sheets including the one immediately below the topmost sheet. However, the sheet immediately below the topmost sheet is floated by a great buoyancy due to the air flows A1 and A2 blown from the sides, and is pressed against the bottom surface of the topmost sheet $P_U$ sucked on the conveyance belt 301. If the sheet pressed against the bottom surface of the sucked topmost sheet $P_U$ is conveyed together with the topmost sheet $P_U$ sucked by the drive of the conveyance belt 301, a multiple sheet feed occurs.

The sheet feeding device PS provided with the rise prevention member (A) 261 and rise prevention member (B) 262 eliminates the possibility of the aforementioned multiple sheet feed, even if the sheet has a downwardly convexed curl in the direction perpendicular to sheet feed.

FIG. 7C shows the state corresponding to the aforementioned FIG. 6B in the structure provided with rise prevention member (A) 261 and rise prevention member (B) 262. To be more specific, this diagram shows that air flow AS for attracting sheets toward the conveyance belt 301 is formed, the blower fans 211F and 212F are operating and air flows A1 and A2 are blown from the floating air outlet 211H and floating air outlet 212H.

The air flows A1 and A2 are blown from the illustrated lateral surfaces of the sheets P placed on the sheet stacking table 201. The sheets placed on the sheet stacking table 201 have a downwardly convexed curl in the direction perpendicular to sheet feed, and are floated due to the increased buoyancy given by the air flows A1 and A2 blown from the side thereof. The floated sheet is contacted by the rise prevention member (A) 261 and rise prevention member (B) 262. The air flow AS for attracting sheets toward the conveyance belt 301 works on the topmost sheet $P_U$ contacted by the rise prevention member (A) 261 and rise prevention member (B) 262 to make the sheet $P_U$ to be sucked on the conveyance belt 301.

FIG. 7D shows the state corresponding to the aforementioned FIG. 6C. To be more specific, this diagram indicates that the floated topmost sheet $P_U$ is sucked on the conveyance belt 301. As illustrated, an upwardly convexed cud is formed in the direction perpendicular to sheet feed is formed on the topmost sheet sucked on the conveyance belt 301 by being contacted by the rise prevention member (B) 262.

When the topmost sheet $P_U$ is sucked on the conveyance belt 301, the air flow AS for attracting sheets toward the conveyance belt 301 works on the topmost sheet $P_U$ alone, not on the lower sheets including the one immediately below the topmost sheet. Thus, the sheets at lower positions are contacted by the rise prevention member (B) 262 so that a further rise is prevented. Only the topmost sheet $P_U$ is separated from the lower sheets and is sucked on the conveyance belt 301.

As illustrated above, even when the sheet placed on the sheet stacking table 201 has a downwardly convexed curl in the direction perpendicular to sheet feed, the sheets floated by a great buoyancy are contacted by the rise prevention member (A) 261 and rise prevention member (B) 262. This procedure allows only the topmost sheet to be sucked on and conveyed by the conveyance belt 301, without any possibility of multiple sheet feed.

As described above, arrangement of the rise prevention member (A) 261 and rise prevention member (B) 262 ensures the curled sheets to be separated and sucked. It is also possible to make such arrangements that the floating sheets are further exposed to the air blown from the leading edge contacting portion 221. If the air is blown to the floating sheets from the leading edge contacting portion 221, more reliable sheet separation can be ensured.

The aforementioned sheet separation is carried out in the process wherein the sheet feeding device PS performs the sheet feeding operation.

In the sheet feeding device PS in the present embodiment, sheets are supplied to the image forming apparatus under the control of the image forming apparatus, namely, the sheet feeding operation is performed in an image forming system where the sheet feeding device is connected to the image forming apparatus.

The following describes the control of the sheet feeding operation that the sheet feeding device PS performs in the image fanning system where the sheet feeding device PS of the present embodiment is connected to an image forming apparatus A.

Figure 8:
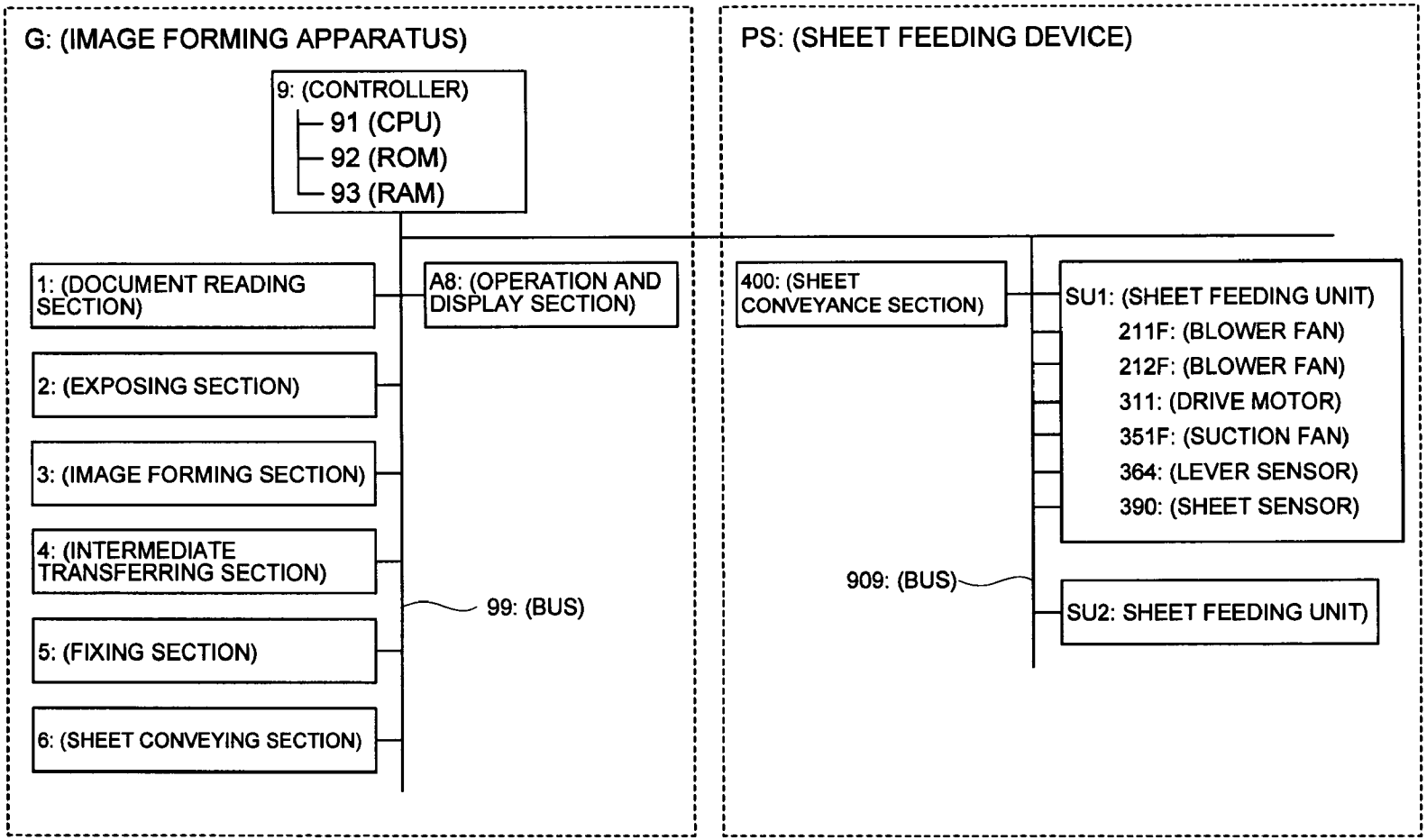
FIG. 8 is a block diagram showing the control system for controlling the sheet conveyance operation in the image forming system of the present embodiment.

FIG. 8 is a block diagram showing the control system for controlling the sheet conveyance operation in the image forming system of the present embodiment. This diagram mainly illustrates the portions required to explain the operations related to the sheet suction and conveyance control in the sheet feeding device PS of the present embodiment. The other conventionally known portions of the image forming system are not illustrated.

The controller 9 of the image forming apparatus G is a computer system including CPU 91, ROM 92 and RAM 93.

The CPU 91 controls the image forming operation of the image forming apparatus G by executing the program stored in the ROM 92, and controls the sheet feeding device PS so that it operates synchronously with the image forming operation of the image forming apparatus G.

The ROM 92 stores the programs for operating the image forming apparatus G, programs for operating the sheet feeding device PS, and a plurality of constants required to control respective operations. The stored constants include the standby time $t_k$. The standby time $t_k$ will be described later.

The RAM 93 can store a plurality of pieces of information allows reading them out. The RAM 93 stores the data generated or acquired during the control of the image forming apparatus G or sheet feeding device PS by the CPU 91. The RAM 93 also serves as a timer for the control of respective operations.

The reference numeral 99 denotes a bus. The bus 99, together with the controller 9, is connected with a document reading section 1, exposing section 2, image forming section 3, intermediate transfer section 4, fixing section 5, sheet conveyance section 6, and operation and display section 8 to permit mutual exchange of information.

Based on the job information inputted from the operation and display section 8, the controller 9 controls the operation of the components connected with the bus 99, and allows the sheet conveyance section 6 to operate to feed sheets so that images are formed on the conveyed sheets.

The reference numeral 909 of the sheet feeding device PS denotes a bus, which is connected to the image forming apparatus. The bus 909 is connected with the sheet feeding units SU1 and SU2, and sheet conveyance section 400.

When the job uses the sheet stored in the sheet feeding device PS, the controller 9 controls the operation of the sheet feeding device PS and allows the sheet according to the job information to be conveyed to the image forming apparatus G, wherein an image is formed on the sheet. The sheet feeding device PS picks up sheets from either the sheet feeding unit SU1 or SU2 under the control of the controller 9 of the image forming apparatus G. These sheets are then conveyed to the image forming apparatus G.

Figure 9:
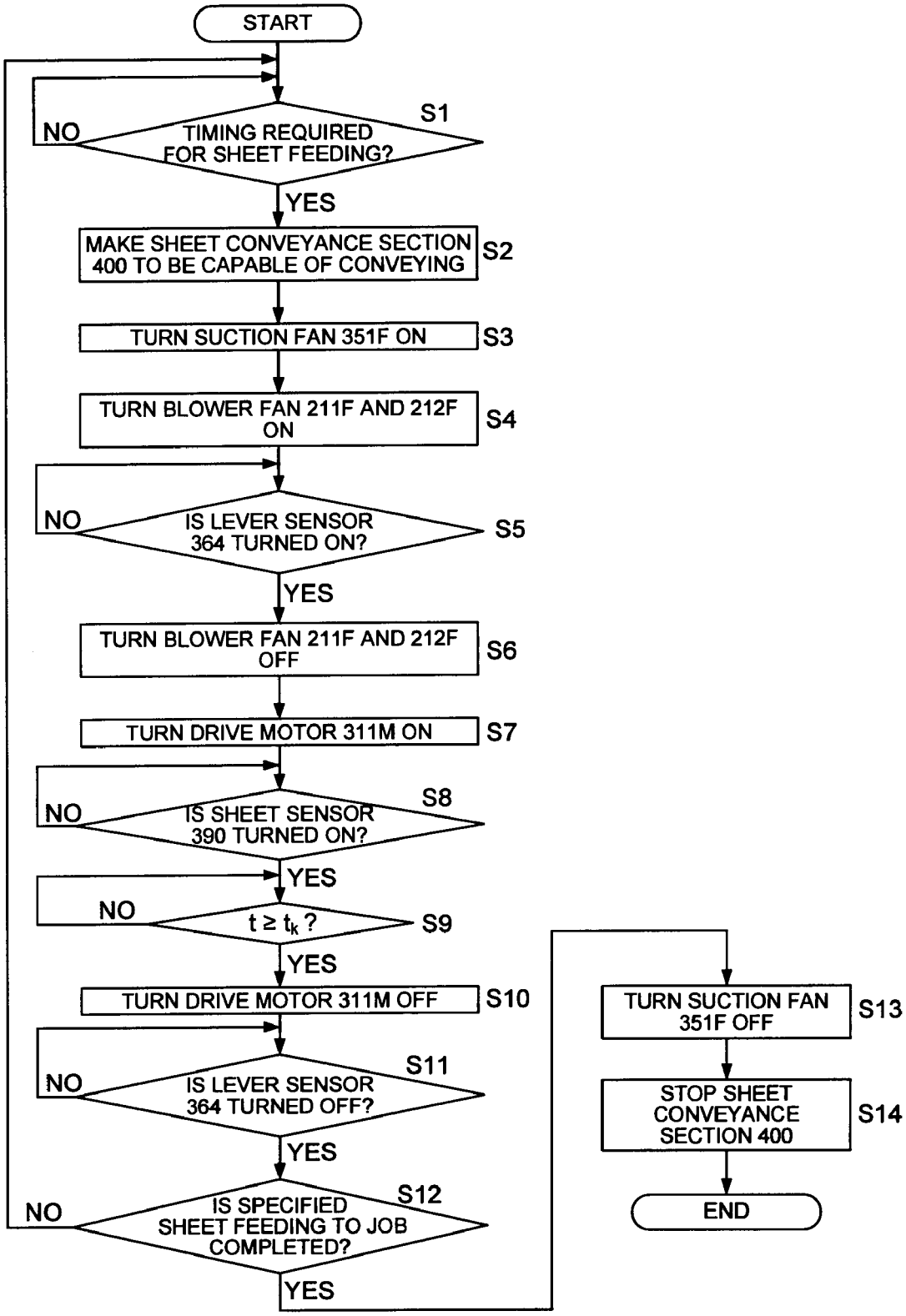
FIG. 9 is a flow chart showing the operations of feeding sheets from the sheet feeding device PS in the image forming system of the present embodiment.

FIG. 9 is a flow chart showing the operations of feeding sheets from the sheet feeding device PS in the image forming system of the present embodiment.

In the process of implementing a job wherein an image is formed by the image forming apparatus G using the sheets stored in the sheet feeding device PS, the CPU 91 waits for the time when conveyance of sheets from the sheet feeding device PS is required. When this time has come (Step S1: Yes), the CPU 91 goes to Step S2, and puts the sheet conveyance section 400 of the sheet feeding device PS into a conveyance enable state. A conveyance enable state is the state wherein the roller provided on the sheet conveyance section 400 rotates and the sheet received in the sheet conveyance path can be conveyed to the image forming apparatus G. If the sheet conveyance section 400 is already operating, its operating state is kept unchanged.

This is followed by Step S3 wherein the suction fan 351F of the sheet feeding unit SU (either the sheet feeding unit SU1 or SU2) for storing the sheets specified in the job is turned on to start operation. When the operation of the suction fan 351F has started, an air flow AS is generated to attract sheets P on the sheet storage section 200 toward the conveyance belt 301. If the suction fan 351F is already turned ON, its ON state is kept unchanged. This ON state is illustrated in the aforementioned FIG. 6A.

In Step S3, the blower fans 211F and 212F of the sheet feeding unit SU for storing the sheets in the job are turned on to start operation. When the operation of the blower fans 211F and 212F has started, the air flows A1 and A2 are blown out to float the sheets P placed on the sheet storage section 200. This state is illustrated in the aforementioned FIG. 6B.

The sheets are floated by the air flows A1 and A2, and the topmost sheet is contacted by the rise prevention member (A) 261 and rise prevention member (B) 262 and is sucked on the conveyance belt 301.

The CPU 91 waits until the lever sensor 364 is turned on in the following Step S5. The lever sensor 364 is turned on when a sheet is sucked on the conveyance belt 301. When the lever sensor 364 is turned on (Step S5: Yes), namely, a sheet is sucked on the conveyance belt 301, the operation goes to Step S6, and the blower fans 211F and 212F in the ON state is turned oft namely, the operations of these fans are stopped. When the blower fans 211F and 212F are stopped, blowing of the air flows A1 and A2 is suspended and the floating sheets fall to the sheet stacking table 201 to be stacked on other sheets. This is the state illustrated in the aforementioned FIG. 6D. One sheet is sucked on the conveyance belt 301.

In Step S7, the drive motor 311M of the sheet feeding unit SU for storing the sheets specified in the job is turned on and is operated. The conveyance belt 301 is driven by the operation of the drive motor 311M, and the sucked sheet is conveyed toward the sheet conveyance section 400.

The CPU 91 waits until the sheet sensor 390 is turned on in Step S8. Upon detection of the sheets P to be conveyed, the sheet sensor 390 turns on (Step S8: Yes). To be more specific, when the leading edge of the sheet to be conveyed has reached the sheet sensor 390, the operation goes to Step S9. The RAM 93 also serving as a timer counts the time t elapsed from the moment the sheet sensor 390 turned on. The CPU 91 waits until the elapsed time t reaches the standby time $t_k$. The standby time $t_k$ is the time required before the leading edge of the sheet to be conveyed passes by the sheet sensor 390 and is held by the inlet conveyance roller 400R1 and inlet driven roller 400R2 arranged on the sheet conveyance section 400. This time is preset by giving consideration to the sheet conveyance speed by the conveyance belt 301 and the distance between the sheet sensor 390, inlet conveyance roller 400R1 and inlet driven roller 400R2. The standby time $t_k$ is stored in the ROM 92.

The elapsed time t reaches the standby time $t_k$ (Step S9: Yes). To put it another way, when the leading edge of the sheet to be conveyed passes by the sheet sensor 390 and is held by the inlet conveyance roller 400R1 and inlet driven roller 400R2, the drive motor 311M is turned off in Step S10 and the conveyance belt 301 is suspended. The sheet is conveyed by being sandwiched by the inlet conveyance roller 400R1 (in the active mode in Step S2) and inlet driven roller 400R2. The sheet is then introduced to sheet conveyance path of the sheet conveyance section 400 and is supplied to the image forming apparatus G.

This is followed by the Step S11 wherein the system waits until the lever sensor 364 is turned off The lever sensor 364 is turned on when the tip end of the adhesion detection lever 361 has contacted the sheet sucked on the conveyance belt 301. The sucked sheet is conveyed by being held by the inlet driven roller 400R2. When the sheet has moved to a position where the sheet does not contact the adhesion detection lever 361, the lever sensor 364 is turned off. When the lever sensor 364 is turned off (Step S11: Yes), that is, when the sheet has moved to a place where the sheet does not contact the adhesion detection lever 361, the system goes to Step S12.

In Step S11, the CPU 91 determines whether or not the sheet supply work specified in the job has been completed by the supply of sheets performed in Steps S1 through S11. Whether the sheet supply work has been completed or not can be determined by comparison between the number of the sheets specified in the job and the sum of the sheets having been fed to the image forming apparatus G from the sheet feeding device PS. If the number of the sheets having been fed fails to meet the number of the sheets specified in the job, the sheet feeding operation is determined as not having been completed. If there is agreement between the number of the sheets having been fed and the number of the sheets specified in the job, the sheet feeding operation is determined as having been completed.

If the sheet feeding operation is determined as not having been completed in Step S12 (Step S12: No), the system goes back to Step S1. Then the Steps S1 through Step S11 are repeated until the sheet feeding operation is determined as having been completed in Step S12. If the sheet feeding operation is determined as having been completed in (Step S12: Yes), the system goes to Step S13.

In Step S13, the working suction fan 351F is turned off to stop the operation. This is followed by the Step S14 wherein the roller of the sheet conveyance section 400 that is in the conveyance enable state is stopped to terminate the operation of feeding sheets from the sheet feeding device PS.

The aforementioned sheet feeding operations of the sheet feeding device PS are all controlled by the controller 9 as a control means of the image forming apparatus G. It is also possible to make such arrangements that the sheet feeding device is provided with a control means to control the sheet feeding operation in collaboration with the control means of the image forming apparatus.

The present invention provides a sheet feeding device having an air sheet feeding device of simple structure capable of picking up sheets one by one and conveying them with certainty without being affected by curl of the sheets stored in the sheet storage section.

What is claimed is:

1. A sheet feeding device comprising:

(a) a sheet storage section which stores sheets thereon;

(b) a leading edge contacting section having a leading edge contacting surface with which a leading edge side in a sheet conveyance direction of the sheets stored in the sheet storage section, comes in contact;

(c) a blowing section having an air outlet which blows air to float the sheets from a side surface perpendicular to the sheet conveyance direction of the sheets stored;

(d) a sucking and conveying section provided at an upward position above the sheet storing section, which sucks the sheet floated by the air from the blowing section, and conveys the sheet over an upper end of the leading edge contacting section; and (e) a rise prevention member provided on a side of the sucking and conveying section, which comes in contact with the sheet floated by the air from the blowing section and prevents a contacting portion of the floated sheet which is in contact with the rise prevention member, from being risen, wherein the rise prevention member is arranged upstream of the leading edge contacting surface in the sheet conveyance direction and downstream of the air outlet in the sheet conveyance direction.

2. The sheet feeding device of claim 1, wherein a height of a part of the rise prevention member which comes in contact with the floated sheet is lower than that of an upper end of the leading edge contacting section.

3. The sheet feeding device of claim 2, wherein a portion on the rise prevention member that is opposite to the sheet floated by the air from the blowing section, has a inclination at which the portion is lowered as the portion moves away from a vicinity of the sucking and conveying section.

4. An image forming system having an image forming apparatus that forms an image onto a sheet, and a sheet feeding device that conveys the sheet to the image forming apparatus, which is connected thereto, the sheet feeding device comprising:

(a) a sheet storage section which stores sheets thereon;

(b) a leading edge contacting section having a leading edge contacting surface with which a leading edge side in a sheet conveyance direction of the sheets stored in the sheet storage section, comes in contact;

(c) a blowing section having an air outlet which blows air to float the sheets from a side surface perpendicular to the sheet conveyance direction of the sheets stored;

(d) a sucking and conveying section provided at an upward position over the sheet storing section, which sucks the sheet floated by the air from the blowing section, and conveys the sheet over an upper end of the leading edge contacting section; and (e) a rise prevention member provided on a side of the sucking and conveying section, which comes in contact with the sheet floated by the air from the blowing section and prevents a contacting portion of the floated sheet which is in contact with the rise prevention member, from being risen, wherein the rise prevention member is arranged upstream of the leading edge contacting surface in the sheet conveyance direction and downstream of the air outlet in the sheet conveyance direction.

5. The image forming system of claim 4, wherein a height of a part of the rise prevention member which comes in contact with the floated sheet is lower than that of an upper end of the leading edge contacting section.

6. The image forming system of claim 5, wherein a portion on the rise prevention member that is opposite to the sheet floated by the air from the blowing section, has a inclination at which the portion is lowered as the portion moves away from a vicinity of the sucking and conveying section.

* * * * *